United States Patent [19]

Westfall

[11] Patent Number: 4,518,625

[45] Date of Patent: May 21, 1985

[54] ARC SPRAY FABRICATION OF METAL MATRIX COMPOSITE MONOTAPE

[75] Inventor: Leonard J. Westfall, North Olmsted, Ohio

[73] Assignee: The United States of America as represented by the Administrator of the National Aeronautics and Space Administration, Washington, D.C.

[21] Appl. No.: 560,035

[22] Filed: Dec. 9, 1983

[51] Int. Cl.[3] ..... B05D 1/02; C23C 7/00

[52] U.S. Cl. ..... 427/37; 219/76.14; 427/178; 427/422

[58] Field of Search ..... 427/34, 37, 422, 178; 219/76.14, 121 PL

[56] References Cited

U.S. PATENT DOCUMENTS

| | | | |
|---|---|---|---|
| 2,972,185 | 2/1961 | Brennan | 427/422 |
| 3,010,009 | 11/1961 | Ducati | 427/34 |
| 3,055,591 | 9/1962 | Shepard | 239/13 |
| 3,615,277 | 10/1971 | Kreider et al. | 29/195 |
| 4,045,591 | 8/1977 | Payne | 427/37 |
| 4,078,097 | 3/1978 | Miller | 427/34 |
| 4,302,482 | 11/1981 | Heck | 427/34 |

FOREIGN PATENT DOCUMENTS

| | | | |
|---|---|---|---|
| 2002472 | 7/1971 | Fed. Rep. of Germany | 427/34 |

*Primary Examiner*—John H. Newsome

*Attorney, Agent, or Firm*—Norman T. Musial; John R. Manning; Gene E. Shook

[57] ABSTRACT

Arc metal spraying is used to spray liquid metal onto an array of high strength fibers that have been previously wound onto a large drum contained inside a controlled atmosphere chamber. This chamber is first evacuated to remove gaseous contaminants and then backfilled with a neutral gas up to atmospheric pressure. This process is used to produce a large size metal matrix composite monotape.

10 Claims, 4 Drawing Figures

ARC SPRAY FABRICATION OF METAL MATRIX COMPOSITE MONOTAPE

ORIGIN OF THE INVENTION

The invention described herein was made by an employee of the United States Government and may be manufactured and used by or for the Government for governmental purposes without the payment of any royalties thereon or therefor.

TECHNICAL FIELD

This invention is directed to making a metal matrix composite monotape to be incorporated into the fabrication of high temperature fiber-reinforced superalloy composites. The invention is particularly directed to the fabrication of very large monotape composites by arc spraying metal.

High temperature hot pressing of powder cloth and fiber arrays has been used to fabricate high temperature composite monotapes. This process utilizes open or closed molybdenum dies at temperatures of 1800° F. to 2000° F. to press powders or powder cloth and fiber arrays thereby forming composite monotapes.

The disadvantage of this high temperature hot pressing process is that it limits the size of the monotape that can be produced. More particularly, the limiting factor is the size of the hot die channel which is about 3 to 4 inches wide by 7 to 8 inches long.

It is, therefore, an object of the present invention to provide an improved method of making large sheets of a metal matrix composite monotape used in the fabrication of structural panels and the like.

Another object of the invention is to provide a method of arc spraying a metal matrix composite monotape which is supported on a mandrel without preheating the mandrel prior to spraying.

BACKGROUND ART

Kreider et al U.S. Pat. No. 3,615,277 is directed to a method of fabricating fiber reinforced articles including fiber reinforced monolayer composite tapes. A multilayer composite is produced from a plurality of single layer plasma sprayed tapes. A filamentary material is affixed to a mandrel which is positioned in a plasma spray chamber where deposition of the metal matrix material by means of a plasma torch can be accomplished in an argon atmosphere. Prior to spraying the wound filaments are preheated to assure bonding, and the mandrel is rotated and traversed in front of the stationary plasma arc during spraying to obtain an even layer of matrix material. Subsequent to cooling, the monolayer tape is removed from the mandrel by cutting in a desired manner.

U.S. Pat. No. 4,078,097 to Miller describes a spray gun process for applying an atomized metallic coating to plastic parts evenly without warpage. A spray means in the form of a gun feeds metal to an atomizing means where the metal is melted. In one embodiment a metal wire is supplied to the arc spray gun nozzle where it is atomized. An air stream blows the atomized metal through a housing at a sufficient pressure to keep moisture therein at a minimum. The patent teaches a gas treatment which is preferably air or other nonflammable gas. Before the spray is applied to the plastic material a solvent is sprayed onto the plastic. Also, the metal wires converge at a point in front of the air stream nozzle in the path of the high pressure air stream. The metal wires have a melting point of less than 4200° F. The converging ends of the metal wires are coupled to an electric voltage differential which is sufficient to atomize the two metal wires at their converging ends.

DISCLOSURE OF INVENTION

An arc metal spraying gun is used to spray hot liquid metal onto an array of high strength fibers that have been previously wound onto a large drum contained inside a controlled atmosphere chamber. According to the present invention this chamber is evacuated for a predetermined period of time to remove gaseous contaminants. The chamber is back-filled with a suitable neutral gas up to atmospheric pressure to provide a contaminant free environment for arc spraying metal.

A pair of wires of the metal that is to be melted and sprayed is fed into the arc spray gun assembly that includes an automatic feed mechanism. The large drum containing the wound fiber array is made to rotate while moving back and forth along the length of the chamber in order to expose the entire surface of the array to the molten metal spray. While the wires are being fed to the arc spray gun assembly, a neutral gas is supplied at a high pressure between about 60 psi to about 120 psi. This gas is directed to a region directly behind the arc to facilitate optimum spraying.

The gun assembly is connected to a source of electrical power which produces an electric arc between the wires causing the tips to melt. The high velocity of the neutral gas forces the liquid metal to move away from the arc spray gun and onto the fiber wound drum. By controlling the gas pressure, voltage, wire feed rate, and the rotation and reciprocation of the fiber wound drum, a desired thickness of metal is deposited onto the fiber array.

The resulting arc sprayed monotape is then removed from the drum in a conventional manner. This is facilitated by a suitable release agent applied to the drum surface prior to winding. The large sheets of monotape produced by the process of the invention are used in the fabrication of large diameter tubes and turbine blades that must have a single layer of fiber reinforced monotape wrapped around the entire structure. Other high temperature components, such as combustion liners and hot gas ducts, can be produced with the material of the present invention.

BRIEF DESCRIPTION OF THE DRAWING

The details of the invention will be described in connection with the accompanying drawings wherein.

BEST MODE FOR CARRYING OUT THE INVENTION

Figure 1:
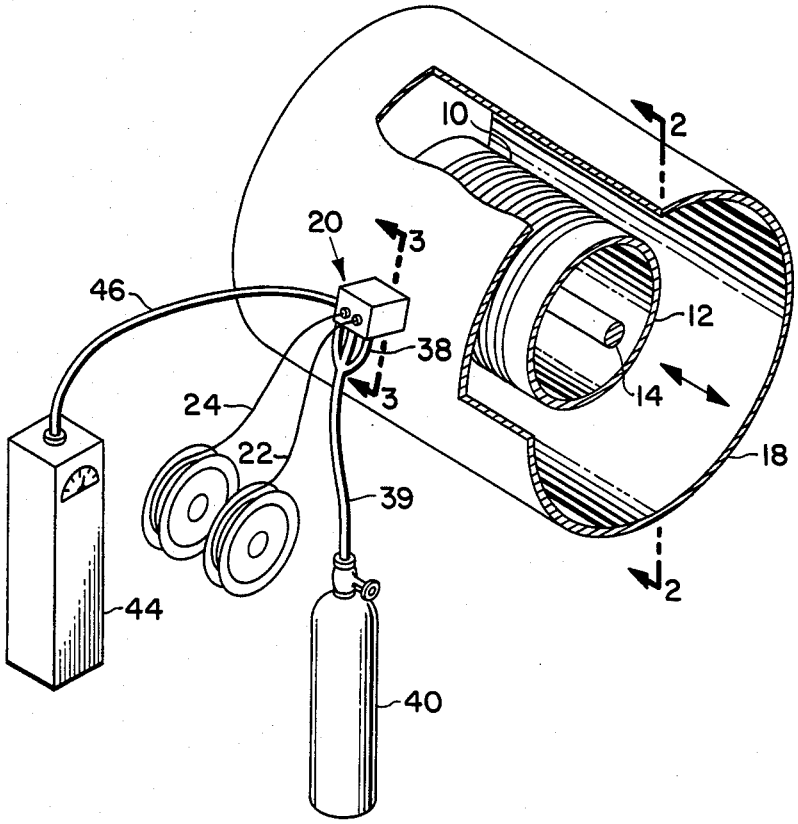
FIG. 1 is a schematic perspective view, with parts broken away, of apparatus for performing the method of the present invention.
Figure 2:
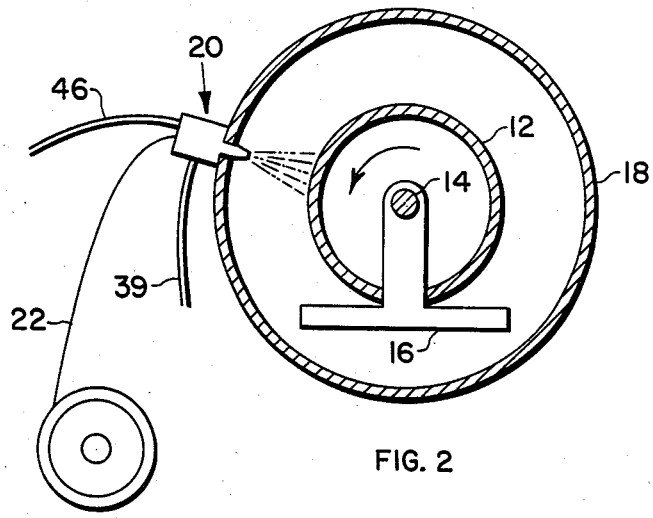
FIG. 2 is a vertical section view taken along the line 2—2 in FIG. 1.

Referring now to the drawings, there is shown in FIGS. 1 and 2 an array of high strength fibers 10 wound on a large drum 12 forming a mandrel having a centrally disposed axle shaft 14 extending along its longitudinal axis. The axle shaft 14 is carried by a drive mount 16 which provides for both longitudinal and rotational motion of the drum 10 in a conventional manner.

Monotapes using tungsten alloy fibers have been fabricated in accordance with the present invention. Also, fibers of silicon carbide and boron carbide coated boron have been used. It is contemplated that other metal alloy fibers or ceramic fibers may be used.

Reciprocating longitudinal motion is indicated by the arrow in FIG. 1 while rotational movement is indicated by the arrow in FIG. 2. The drum 10 and the drive 16 are contained within a chamber 18 which provides for a controlled atmosphere. An arc spray gun assembly 20 is mounted in the wall of the chamber 18.

A suitable mold release agent is first applied to the drum 12. The fibers 10 are then wound onto the drum 12 in such a way as to produce the desired fiber spacing together with the predetermined width of the fiber layup. The limit of the width and length of the fiber layup is the size of the drum 12 onto which the fibers are wound.

With the fibers 10 wound onto the drum 12, the chamber 18 is evacuated for a sufficient time to prepare for the spraying process. This evacuation removes undesirable gaseous contaminants, such as oxygen and nitrogen, from the chamber 18. This chamber is then backfilled with argon, or other suitable neutral gas, up to atmospheric pressure.

Figure 3:
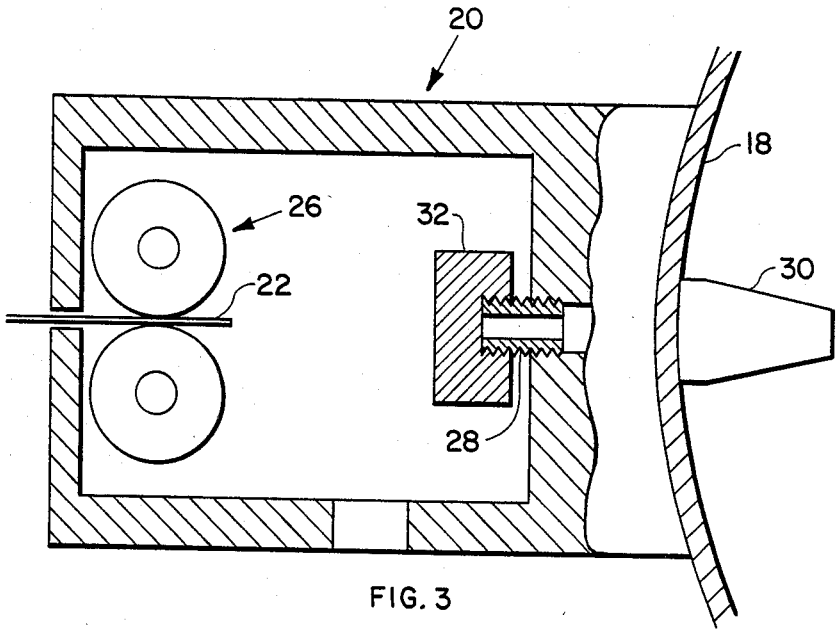
FIG. 3 is an enlarged vertical section view taken along the lines 3—3 in FIG. 1 showing the gun assembly prior to arc spraying.
Figure 4:
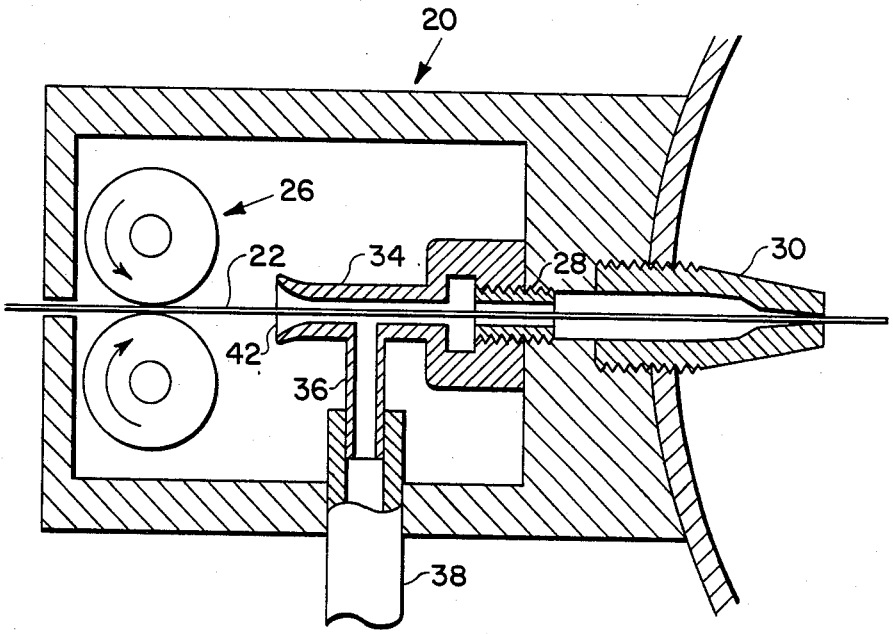
FIG. 4 is an enlarged vertical section view similar to FIG. 3 showing the gun assembly during arc metal spraying.

Two metal wires 22 and 24 that are to be melted and sprayed are inserted into the arc spray gun assembly 20 as shown in FIGS. 1 and 2. The wires 22 and 24 are supplied by automatic feed mechanisms 26 to wire guide feed-through fittings 28 as shown in FIG. 4. Each wire 22 and 24 is provided with an automatic feed mechanism 26 and a feed-through fitting 28. Thus, the gun assembly 20 contains two fittings 28, each of which is in communication with a wire guide 30 as shown in FIGS. 3 and 4.

An important feature of the invention is that the arc spray gun assembly 20 is constructed to accept a vacuum on the side toward the interior of the chamber 18. The wire feed-through fittings 28 shown in FIGS. 3 and 4 are provided with novel caps 32 and purge tubes 34 instead of straight hollow tubes that are used with conventional metal arc spraying guns that can spray only in an ambient environment.

In preparation for the evacuation of the chamber 18, the arc spray gun assembly 20 is sealed to prevent gas leaks. This is accomplished by securing a vacuum tight cap 32 over each wire guide feed-through fitting 28 in the gun assembly 20 as shown in FIG. 3. The chamber 18 is then evacuated for a sufficient time to remove unwanted gasses.

After evacuation the chamber 18 is backfilled with argon, or a suitable neutral gas, to slightly above atmospheric pressure. The vacuum tight caps 32 are removed from the feed-through fittings 28 and replaced with gas purge tubes 34 as shown in FIG. 4.

The neutral gas is supplied to a branch passage 36 in each purge tube 34 by a line 38 as shown in FIG. 4. The line 38 is connected to a main gas conduit 39 which, in turn, is connected to a suitable supply 40 of the neutral gas, such as argon, as shown in FIG. 1. The pressure of the gas at the supply 40 is between about 60 psi and about 120 psi.

The gas pressure at the source 40 forces the neutral gas into the purge tube 34, feed-through 28, and wire-guide 30 for each wire 22 and 24 into the chamber 18. A portion of this neutral gas also discharges from a tapered end 42 of each of the purge tubes 34.

The wires 22 and 24 are inserted into the tapered ends 42 of the purge tubes 34, and the feed mechanisms 26 move these wires into the feed-through fittings 28. Gaseous contaminants are removed from the surfaces of the incoming wires 22 and 24 in the purge tube 34 by the pressurized argon as it flows therethrough and discharges from the tapered end 42.

A suitable D.C. power supply 44 is connected to the wire guides 30 in the spray gun assembly 20 by a conductor 46 in a conventional manner. The wire guides transfer the electric field from the power supply 44 to the wires 22 and 24 and place them in a predetermined position which enables an electric arc to be struck between the wire tips. The arc causes the tips of the wires to melt and reach a temperature of approximately 3500° F. or higher.

The line 39 conveys neutral gas from the source 40 to a position behind the arc in a conventional manner. The high velocity of the gas forces molten metal from the arc to move away from the wire guide 30 and deposit onto the fibers 10 on the drum 12 which is in close proximity to the gun assembly 20. The gas pressure in the supply 40 is very carefully controlled to ± two psi. Also the voltage from the power supply 44 is carefully regulated to ± one volt. The wire feed rates from the feed mechanisms 26 are accurately controlled by the use of a suitable counting device. Likewise, the rotation and longitudinal motion of the fiber wound drum 12 is accurately monitored with high torque speed controllers.

In this manner the desired metal thickness will be deposited onto the fibers 10 on the drum 12. Also, all of the fibers 10 in the array on the drum 12 are sprayed. The arc sprayed monotape can be easily removed from the drum with the use of a suitable polymeric release agent applied initially to the surface of the drum 12. A polytetrafluoroethylene material, known commercially as Teflon, has been a suitable release agent.

The beneficial technical effect of this fabrication technique over the prior art is the size, lower cost, and relative production rate of the high temperature monotape that is produced. Additional advantages are evident through the reduced level of impurities such as oxides, excess carbon, or trapped residue on the monotape compared to monotapes fabricated by previous methods.

There are some applications that demand a large sheet of monotape, such as the fabrication of large diameter tubes or turbine blades, that must have several layers of fiber reinforced monotape wrapped around the entire piece. In this situation the width of the monotape can quickly exceed the size of the conventional hot pressed monotape. The process of the present invention provides for the production of fiber reinforced monotape to any dimension limited only by the size of the drum 12 onto which the metal is sprayed from the gun assembly 20.

The cost of performing the disclosed process is much less than the competing powder cloth processes. In the present invention no binder is used. The cost and time of the powder cloth fabrication is eliminated. It takes approximately the same time to make a hot pressed monotape 2 in. by 7 in. as it does a single arc sprayed metal monotape of 15 in. by 45 in. This represents a production rate increase of 45 to 1.

Another advantage is that the purity of the material produced in accordance with the present invention is much higher than that produced by conventional powder cloth processes. The matrix wire for the present invention can be purchased in a very clean condition. This cleanliness is maintained in the spraying process because of the clean neutral gasses that are used and the very short time that is involved in transforming the metal wire into monotape matrix. The problem of contamination from a binder that must be removed in the powder cloth process is eliminated by the present invention.

Still another advantage of this process results from the high temperature of the liquid metal. The high temperature of the process enables the liquid metal to adhere to the fiber array 10 without preheating the fiber array on the drum 12. Also, all the high temperature phases, such as carbides, will be melted along with the parent metal, thus producing a very homogeneous metal matrix.

A further advantage of this process is the very clean nature of the metal matrix. Because the liquid metal is surrounded by inert gas and only remains liquid for a very short time, the cleanliness of the metal is maintained and transferred to the monotape. This advantage is contrasted to competing methods of producing monotape that use powder metallurgy techniques. Powders of high temperature materials tend to form metal oxide layers on the surface of the powders. These oxide layers are usually trapped in the metal matrix of the fiber reinforced monotape and may be harmful to the mechanical properties of the material. Also, the use of binders may result in residual carbon contamination.

While the preferred embodiment of the invention has been disclosed and described, it will be apparent that various modifications may be made to the invention without departing from the spirit thereof or the scope of the subjoined claims.

We claim:

1. A method of making a metal matrix composite monotape comprising the steps of mounting an array of fibers on a support means in a chamber, evacuating said chamber to remove gaseous contaminants therefrom, filling said chamber with a neutral gas until the pressure within said chamber is above atmospheric, inserting a pair of wires of the matrix metal into feed-through openings in a wall of said chamber and feeding said wires into said chamber until the extreme outermost ends thereof are in close proximity to said fiber array, striking an arc between said outermost end portions thereby causing the same to melt, and passing a high velocity stream of said neutral gas at a pressure between about 60 psi and about 120 psi through said arc into said chamber thereby forcing molten matrix metal from said arc in said stream to spray onto said array in said contaminant free atmosphere.

2. A method of making a metal matrix composite monotape as claimed in claim 1 wherein the neutral gas is argon.

3. A method of making a metal matrix composite monotape as claimed in claim 1 wherein said array of fibers is moved relative to said stream of gas so that said gas strikes all of the fibers in said array.

4. A method of making a metal matrix composite monotape as claimed in claim 3 including the step of removing gaseous contaminants from the surfaces of said metal wires prior to melting.

5. A method of making a metal matrix composite monotape as claimed in claim 4 wherein the gaseous contaminants are removed by directing portions of said stream of said neutral gas over said surfaces.

6. In a method of making a metal matrix composite monotape wherein at least one metal is arc sprayed onto an array of fibers, the improvement comprising the steps of mounting said fiber array in a chamber having an opening therein for passing a supply of said metal to the interior thereof during said arc spraying, sealing said opening in said chamber, evacuating said chamber to remove gaseous contaminants therefrom, filling said evacuated chamber with a neutral gas until the pressure within said chamber is above atmospheric, unsealing said opening in said chamber when the same is filled with said neutral gas, passing said supply of metal through said opening into close proximity to said fiber array, striking an arc at said metal adjacent to said fiber array thereby melting a portion of said metal, and passing a high velocity stream of said neutral gas at a pressure between about 60 psi and about 120 psi through said arc into said chamber thereby arc spraying said metal onto said fibers in said array in said neutral gas.

7. A method of making a metal matrix composite monotape as claimed in claim 6 wherein the neutral gas is argon.

8. A method of making a metal matrix composite monotape as claimed in claim 6 wherein said array of fibers is moved relative to said stream of gas so that said gas strikes all of the fibers in said array.

9. A method of making a metal matrix composite monotape as claimed in claim 8 wherein gaseous contaminants are removed from the surface of said metal prior to melting.

10. A method of making a metal matrix composite monotape as claimed in claim 9 wherein the gaseous contaminants are removed by directing a stream of said neutral gas over said surface as said metal passes through said opening into said chamber.

* * * * *